US011419393B2

(12) United States Patent
Yamagishi

(10) Patent No.: US 11,419,393 B2
(45) Date of Patent: Aug. 23, 2022

(54) SLIDER FOR CONCEALED SLIDE FASTENER

(71) Applicant: YKK CORPORATION, Tokyo (JP)

(72) Inventor: Koji Yamagishi, Kurobe (JP)

(73) Assignee: YKK CORPORATION

( * ) Notice: Subject to any disclaimer, the term of this patent is extended or adjusted under 35 U.S.C. 154(b) by 0 days.

(21) Appl. No.: 17/392,502

(22) Filed: Aug. 3, 2021

(65) Prior Publication Data

US 2021/0361035 A1 Nov. 25, 2021

Related U.S. Application Data

(63) Continuation of application No. PCT/JP2019/004350, filed on Feb. 7, 2019.

(51) Int. Cl.
*A44B 19/30* (2006.01)

(52) U.S. Cl.
CPC ..... *A44B 19/308* (2013.01); *A44B 19/306* (2013.01)

(58) Field of Classification Search
CPC ..... A44B 19/308; A44B 19/306
See application file for complete search history.

(56) References Cited

U.S. PATENT DOCUMENTS 3,011,238 A 12/1961 McNamara
3,099,059 A * 7/1963 Huelster ..... A44B 19/306 24/421
3,138,852 A * 6/1964 Mazura ..... B21D 53/54 29/710
4,099,302 A 7/1978 Frohlich et al.
5,956,819 A 9/1999 Terasaki et al.
9,844,246 B2 * 12/2017 Yamagishi ..... A44B 19/30
10,813,419 B1 * 10/2020 Lin ..... A44B 19/301
2006/0000067 A1 1/2006 Yoneshima
(Continued)

FOREIGN PATENT DOCUMENTS

CN 1720837 A 1/2006
CN 106455767 A 2/2017
(Continued)

OTHER PUBLICATIONS

Office Action for Bangladesh patent application No. 036/2020, filed Jun. 22, 2020, dated Jan. 27, 2021, 1 pg.
(Continued)

*Primary Examiner* — David M Upchurch
(74) *Attorney, Agent, or Firm* — Taylor English Duma LLP

(57) ABSTRACT

A concealed-slide-fastener slider includes a body including: a pair of flanges extending inwardly in the left and right direction from upper end portions of a pair of the side plates; and a raised portion raised upward from an upper wing plate. The body cooperates with a lock member to form a pull attachment portion including a shaft hole that penetrates in the left-right direction. A lower surface of the shaft hole includes an upper surface of the raised portion and is positioned above upper surfaces of the pair of flanges. A pair of fabric accommodating space portions, which accommodate a pair of fabrics fixed to upper sides of the pair of tapes and is partitioned by the raised portion in the left-right direction, is formed between the pull in a rearward lying posture and the pair of flanges in an upper-lower direction.

8 Claims, 5 Drawing Sheets

(56) References Cited

U.S. PATENT DOCUMENTS

| | | | | |
|---|---|---|---|---|
| 2016/0143401 | A1* | 5/2016 | Miyazaki | A44B 19/306<br>24/420 |
| 2017/0224061 | A1* | 8/2017 | Yamagishi | A44B 19/262 |
| 2020/0128926 | A1* | 4/2020 | Miyazaki | A44B 19/308 |

FOREIGN PATENT DOCUMENTS

| | | | |
|---|---|---|---|
| CN | 107249377 | A | 10/2017 |
| CN | 206641468 | U | 11/2017 |
| CN | 211833155 | U | 11/2020 |
| EP | 3922125 | | 12/2021 |
| JP | H10234429 | | 9/1998 |
| JP | 2009000145 | | 1/2009 |
| JP | 6125013 | | 5/2017 |
| JP | 6273371 | | 1/2018 |
| JP | 2018089450 | | 6/2018 |
| TW | 201431508 | | 8/2014 |
| WO | 2016027340 | | 2/2016 |
| WO | 2016092637 | | 6/2016 |

OTHER PUBLICATIONS

Yamagishi, Koji; International Search Report and Written Opinion for PCT/JP2019/004350, filed Feb. 7, 2019, dated May 7, 2019, 12 pgs.

YKK Co., Ltd; Office Action for Chinese patent application No. 202010082797.X, dated May 9, 2022, 18 pgs.

* cited by examiner

SLIDER FOR CONCEALED SLIDE FASTENER

CROSS-REFERENCE TO RELATED APPLICATIONS

The disclosure of PCT International Application No. PCT/JP2019/004350 filed on Feb. 7, 2019, including specification, drawings and claims is incorporated herein by reference in its entirety.

BACKGROUND

The present invention relates to a concealed-slide-fastener slider in which a body of the slider is concealed on a back surface side in a thickness direction of a fabric, and a pull of the slider appears on a front surface side in the thickness direction of the fabric.

A slide fastener slider is provided with an automatic stop function. There are two types of slide fastener sliders which have the automatic stop function.

One type of the sliders is commonly referred to as an automatic slider. This is because contact and separation of a lock member with respect to a pair of element rows are switched depending on whether or not a pulling operation is performed on a pull. By this switching, movement of a body in a front-rear direction is restricted or the restriction is thus released. More specifically, the automatic slider has two functions. A first function is that the lock member automatically contacts the pair of element rows by releasing hands from the pull. As a result, a front-rear position of the slider is locked, and the slider is difficult to be moved. A second function is that the lock member is separated from the pair of element rows by pulling the pull. As a result, the locking is released, and the slider is easily moved.

A second type of the slide fastener sliders having the automatic stop function is commonly referred to as a semi-automatic slider. This is because the contact and separation of the lock member with respect to the pair of element rows are switched depending on postures of the pull with respect to the body. More specifically, a function of the semi-automatic slider is that the front-rear position of the slider is locked when the pull is in a lying posture with respect to the body, and the locking is released when the pull is in an upright posture with respect to the body, regardless of the pulling operation performed on the pull.

Patent Literature 1 discloses an automatic slider. Since a pair of tape grooves is provided on an upper surface of a body, this slider is a concealed-slide-fastener slider. More details are as follows.

The automatic slider includes: a body; a lock member that is capable of locking a front-rear position of the body and is fixed to front and rear sides of an upper portion of the body; and a pull that is attached by the body and the lock member and is capable of rotating in a front-rear direction and swinging in a left-right direction.

The upper portion of the body includes: left and right flanges; an upper wing plate disposed between the left and right flanges; and a pair of tape grooves formed between the upper wing plate and the left and right flanges. Tapes are passed through the pair of tape grooves. The tapes are bent so as to face lower and upper surfaces of the flanges, and fabrics are fixed to portions facing the upper surface. A pair of fabrics covers left and right side portions of an upper surface of the body. Therefore, the automatic slider of Patent Literature 1 is a concealed-slide-fastener slider.

The body cooperates with the lock member to form a pull attachment portion. A hole, through which a pull connecting ring passes, is provided on an inner side of the pull attachment portion. A lower surface of the hole is lower than the upper surfaces of the flanges. The fabrics are disposed above the flanges via the tapes. When the slider is moved by pulling the pull, the connecting ring is pulled up and suspended above the upper surfaces of the flanges, so that the pair of fabrics is not damaged by the pull (connecting ring).

Patent Literatures 2 and 3 disclose a semi-automatic slider. Since no tape groove is provided on left and right side surfaces of a body, this slider is not a concealed-slide-fastener slider. More details are as follows.

The semi-automatic slider includes: a body; a pull that is capable of rotating about a shaft in a front-rear direction; and a lock member that is fixed to a front portion of an upper portion of the body and is displaced in an up-down direction by a cam portion of the shaft. The body includes tape grooves provided between left and right edge portions of an upper wing plate and a lower wing plate facing each other in the up-down direction, that is, on left and right side surfaces. A pair of tapes are passed through the tape grooves, and a pair of fabrics are fixed to the pair of tapes on left and right sides outer than the tape grooves. As a result, since an entire upper surface of the body is exposed between the pair of fabrics, and the upper surface of the body is not completely concealed by the fabrics, the semi-automatic slider disclosed in Patent Literatures 2 and 3 is not a concealed-slide-fastener slider.

[Patent Literature 1] Japanese Patent No. 6273371
[Patent Literature 2] Japanese Patent No. 6125013
[Patent Literature 3] WO2016/092637

SUMMARY

The concealed-slide-fastener slider of the present invention includes a body, a pull, and a lock member. The body guides a pair of tapes that face each other in a left-right direction and a pair of element rows. The pair of element rows is fixed to lower sides of a pair of tape folded portions folded toward lower sides of side edge portions, which face each other, of the pair of tapes. The body includes: a lower wing plate; an upper wing plate that faces a front portion of the lower wing plate; a guide column that joins the upper wing plate and the lower wing plate; a pair of side plates protruding upward from left and right end portions of the lower wing plate; a pair of flanges extending inwardly in the left and right direction from upper end portions of the pair of side plates; and a raised portion raised upward from the upper wing plate.

The pull restricts movement of the body in a front-rear direction by a rearward lying posture with respect to the body and releases the restriction of the movement of the body in the front-rear direction by an upright posture. The pull includes: a shaft, which includes a cam portion engaged with the lock member.

The lock member locks a front-rear position of the body by contacting the pair of element rows, and cooperates with the body to maintain the rearward lying posture and the upright posture of the pull.

The body cooperates with the lock member to form a pull attachment portion. The pull attachment portion includes: a shaft hole that supports the shaft and penetrates in the left-right direction. A lower surface of the shaft hole includes an upper surface of the raised portion and is disposed at a higher position than upper surfaces of the pair of flanges.

A pair of fabric accommodating space portions is formed between the pull in the rearward lying posture and the pair of flanges in an upper-lower direction. The pair of fabric accommodating space portions accommodate a pair of fabrics fixed to upper sides of the pair of tapes and are partitioned by the raised portion in the left-right direction.

It is desirable that upper ranges on the upper surfaces of the pair of flanges are as follows.

That is, only the pair of fabric accommodating space portions are provided in the upper ranges on the upper surfaces of the pair of flanges and are disposed at lower positions than the pull.

It is desirable that the body is as follows.

That is, the body includes: a pair of branch paths of a tape groove between the pair of flanges and the upper wing plate. Only the pair of fabric accommodating space portions is provided in upper ranges on the pair of branch paths is are disposed at a lower position than the pull.

It is desirable that the body, the lock member, and the pull attachment portion are as follows.

That is, the body includes: a front attachment column and a rear attachment column protruding upwardly from the raised portion with an interval therebetween in the front-rear direction. The lock member is bridged between the front attachment column and the rear attachment column. The pull attachment portion is formed by cooperation of the lock member, the front attachment column, the rear attachment column and the raised portion.

More specifically, in addition to the shaft, the pull includes: a pair of rod portions that extend radially about the shaft from two end portions of the shaft; and a grip portion that joins the pair of rod portions on an opposite side of the shaft. Although it does not matter whether the pull includes a protruding portion protruding from the pair of rod portions to an opposite side of the grip with respect to the shaft, it is desirable to minimize inclination of the pull in the left-right direction in the rearward lying posture as follows.

That is, the pull includes: a pair of protruding portions protruding from the pair of rod portions to an opposite side of the grip portion with respect to the shaft. The pair of protruding portions sandwiches the front attachment column when the pull is in the rearward lying posture, and collides with the front attachment column when the pull is inclined in the left-right direction.

Although it does not matter whether the pull can be maintained in a forward lying posture, it is desirable to minimize damage dealt by the pull to the fabric as follows.

That is, the raised portion includes: a step portion that protrudes in a step shape toward the front attachment column in front of the shaft hole. The step portion collides with the pull in a forward lying posture to determine the forward lying posture of the pull.

It does not matter whether the cam portion and the shaft hole are in surface contact with each other when the pull is in the rearward lying posture. However, it is not desirable to maintain the rearward lying posture of the pull by portions other than the cam portion and the shaft hole, since a size of the slider will be increased. Therefore, it is desirable to reduce the size of the slider and minimize portions appearing on a front side with respect to the pair of fabrics as follows.

That is, the cam portion and the shaft hole each include a planar portion. The planar portions are in surface contact when the pull is in the rearward lying posture.

Although the pull may include a portion positioned below the lower surface of the shaft hole when the pull is in the rearward lying posture, it is desirable to maximize dimensions of the pair of fabric accommodating space portions in the up-down direction as follows.

That is, the pull is disposed at a higher position than the lower surface of the shaft hole when the pull is in the rearward lying posture.

DETAILED DESCRIPTION OF EXEMPLIFIED EMBODIMENTS

The slider disclosed in Patent Literatures 2 and 3 is a semi-automatic slider, and is not used for a concealed-slide-fastener. The slider disclosed in Patent Literature 1, as described above, is an automatic slider, not a semi-automatic slider. Therefore, the present inventor started development of a concealed-slide-fastener slider that maintains the function of the semi-automatic slider (the function of locking the front-rear position of the slider when the pull is in the lying posture with respect to the body, and releasing the locking when the pull is in an upright posture with respect to the body, regardless of the pulling operation performed on the pull).

A case in which a slider is formed simply by combining the body and the lock member of the slider disclosed in Patent Literature 1 and the pull of the slider disclosed in Patent Literature 2 is considered. As a result, although the slider in this case becomes a concealed-slide-fastener slider, the pair of fabrics is easily damaged since the pull is always in contact with the pair of fabrics. That is, in the slider of Patent Literature 1, the lower surface of the hole of the pull attachment portion is lower than the upper surfaces of the flanges. As a result, since the lock member acts to press the lower surface of the shaft against the lower surface of the hole of the pull attachment portion, the pull including the shaft comes close to the pair of flanges and contacts the pair of fabrics.

A concealed-slide-fastener slider of the present invention is made in consideration of the above circumstance, and an object thereof is to minimize damage dealt to the pair of fabrics while maintaining the function of the semi-automatic slider.

Figure 5A:
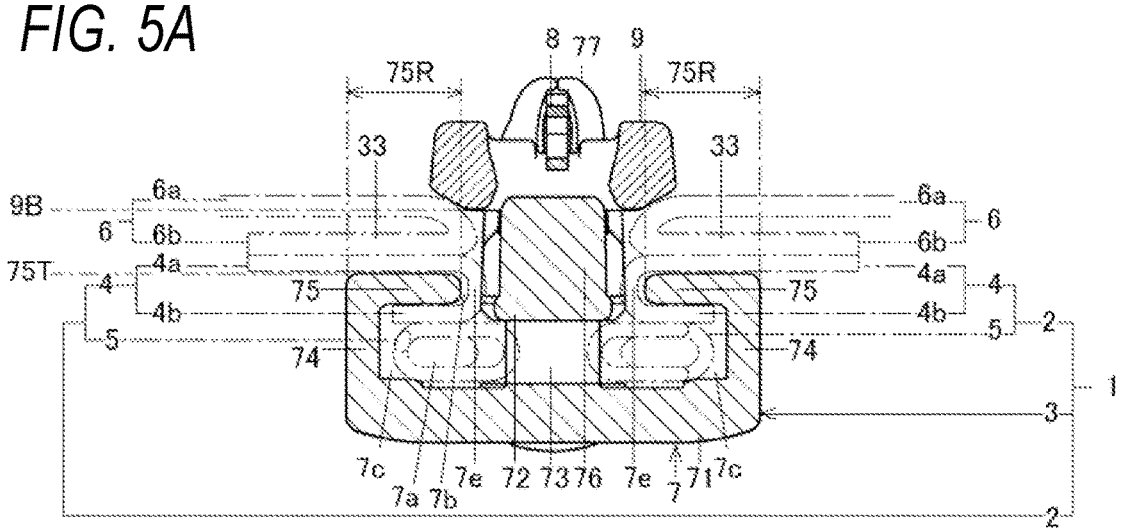
FIG. 5A is a cross-sectional views taken along line V-V of FIG. 1.
Figure 5B:
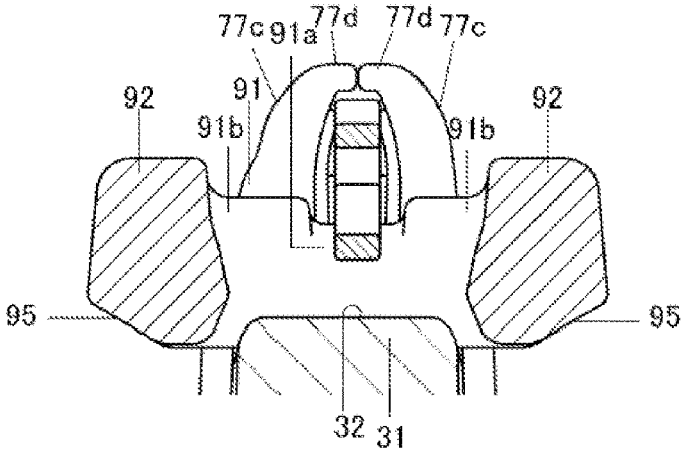
FIG. 5B is a partial enlarged view of FIG. 5A.

As shown in FIGS. 5A and 5B, a concealed-slide-fastener 1 includes: a pair of fastener stringers 2, 2; and a slider 3 configured to open and close the pair of fastener stringers 2, 2.

The pair of fastener stringers 2, 2 includes: a pair of tapes 4, 4 that face each other; and a pair of element rows 5, 5, separately fixed to side edge portions, which face each other, of the pair of tapes 4, 4. In an illustrated example, the element row 5 is formed by bending a monofilament into a coil shape, and elements of one winding of the coil are continuous in a large number.

The concealed-slide-fastener 1 shown in FIGS. 5A and 5B is formed by folding the side edge portions, which face each other, of the pair of tapes 4, 4 and fixing the pair of element rows 5, 5 to the folded portions thereof. More specifically, the pair of tapes 4, 4 is orthogonal to a longitudinal direction and a thickness direction. The pair of tapes 4, 4 includes: a pair of tape main bodies 4*a*, 4*a* on a front side; and a pair of tape folded portions 4*b*, 4*b* which are continuous with side edge portions, which face each other, of the pair of tape main bodies 4*a*, 4*a* and are folded toward a back side. The element row 5 is fixed to a back surface side of the tape folded portion 4*b* by sewing threads (not shown).

On the front side of the pair of tape main bodies 4*a*, 4*a*, a pair of fabrics 6, 6, which are attachment targets of the concealed-slide-fastener 1, is fixed by sewing threads (not shown) with side edge portions thereof, which face each other, folded toward the back side. More specifically, the pair of fabrics 6, 6 includes: a pair of fabric main bodies 6*a*, 6*a* which face each other on the front side; and a pair of fabric folded portions 6*b*, 6*b*, which are continuous with side edge portions, which face each other, of the pair of fabric main bodies 6*a*, 6*a* and are folded toward the back side.

Hereinafter, directions are defined using three linear directions orthogonal to each other.

A first linear direction is a direction in which the pair of fastener stringers 2, 2 faces each other, in other words, a direction in which the pair of element rows 5, 5 faces each other, and is referred to as a left-right direction. The fastener stringer 2 (tape 4) has a strip shape which is folded so that front and back sides thereof overlap with each other, and a strip width direction thereof is the left-right direction. The left-right direction refers to a left-right direction of FIGS. 5A and 5B.

A second linear direction is a longitudinal direction of the pair of fastener stringers 2, 2, in other words, an extension direction of the fastener stringer 2, and is referred to as a front-rear direction.

A front direction is a direction in which the slider 3 is moved when the pair of fastener stringers 2, 2 is closed (when the pair of element rows 5, 5 is engaged with each other). The front direction is a direction facing the back of a direction orthogonal to a paper surface of FIGS. 5A and 5B.

A rear direction is a direction in which the slider 3 is moved when the pair of fastener stringers 2 is opened (when the pair of element rows 5, 5 are separated). The rear direction is a direction facing the front of the direction orthogonal to the paper surface of FIGS. 5A and 5B.

A third linear direction is a thickness direction of the fastener stringer 2, in other words, a thickness direction of the tape 4, and is referred to as an up-down direction. An upward direction refers to an upward direction of FIGS. 5A and 5B. A downward direction refers to a downward direction of FIGS. 5A and 5B.

Figure 1:
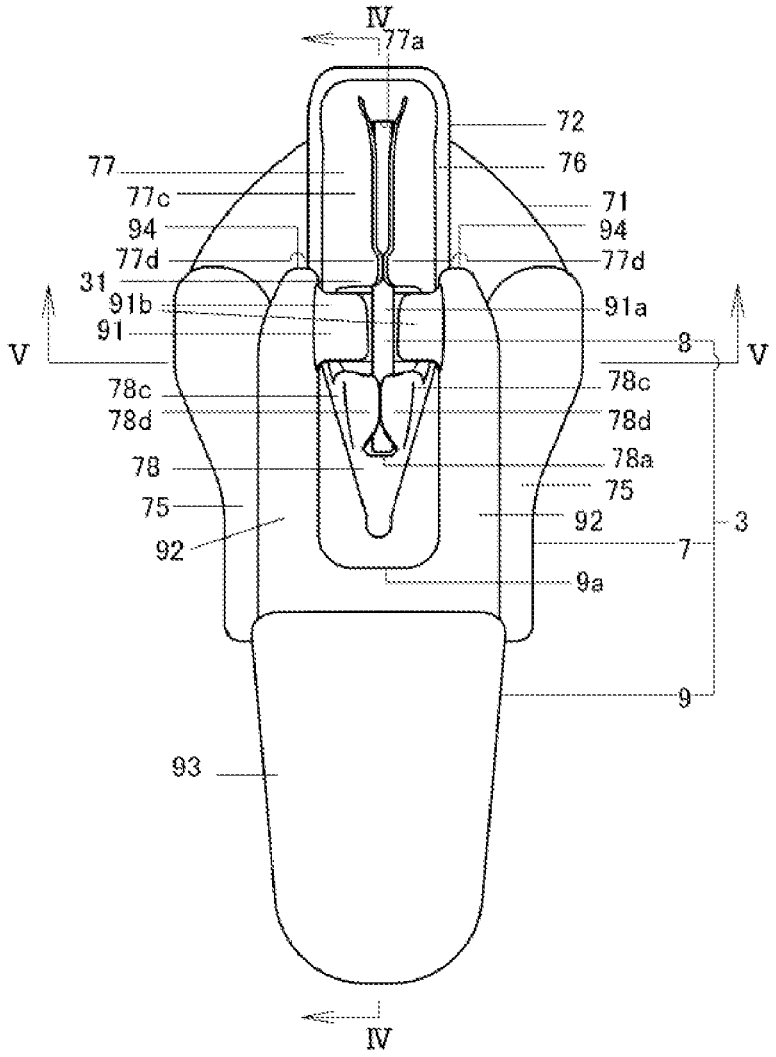
FIG. 1 is a plan view showing a concealed-slide-fastener slider according to a first embodiment of the present invention.

The slider 3 according to a first embodiment of the present invention is as shown in FIG. 1 or FIGS. 5A and 5B, which includes: a body 7, which guides the pair of tape folded portions 4*b*, 4*b* and the pair of element rows 5, 5; a lock member 8, which is capable of contacting and separating from the pair of element rows 5, 5 of the body 7 and locks a front-rear position of the body 7 by contact; and a pull 9, which is attached to the body 7 in a manner that is enabled to rotate in the front-rear direction by the lock member 8 and the body 7.

Figure 6:
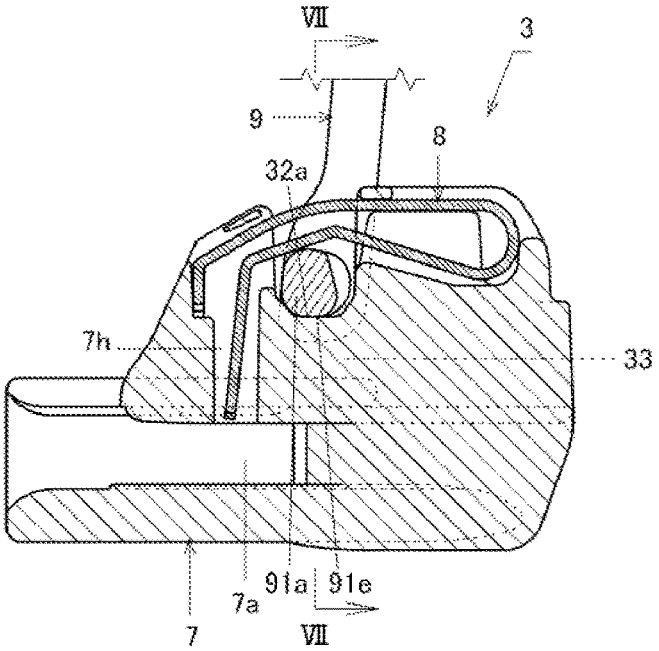
FIG. 6 is a cross-sectional view showing an upright posture of a pull.
Figure 7:
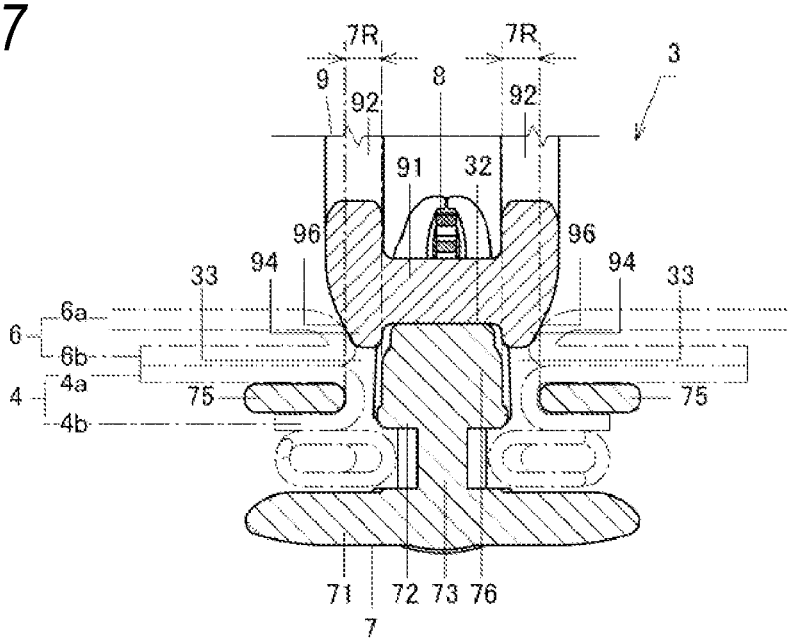
FIG. 7 is a cross-sectional view taken along line VII-VII of FIG. 6.
Figure 8:
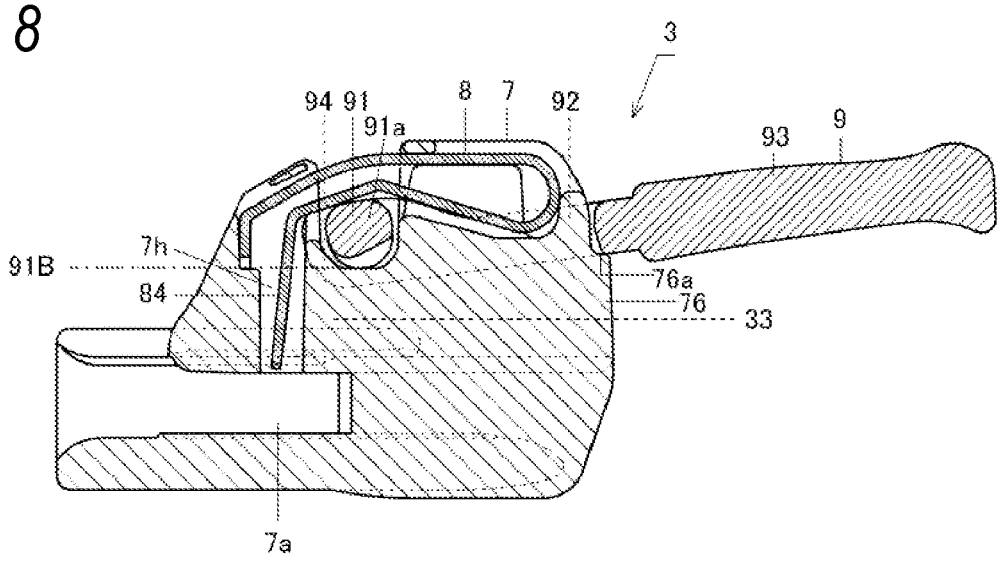
FIG. 8 is a cross-sectional view showing a forward lying posture of the pull.

The pull 9 includes: a shaft 91; a pair of rod portions 92, 92 that face each other in an extension direction of the shaft 91 and extend from two end portions of the shaft 91 in a radial direction of the shaft 91; a grip portion 93 that joins the pair of rod portions 92, 92 on an opposite side of the shaft 91 and is gripped during operation; and a pair of protruding portions 94, 94 protruding from the pair of rod portions 92, 92 to an opposite side of the grip portion 93 with respect to the shaft 91. As shown in FIG. 8, when reaching a front limit position of a rotation range, the pull 9 is in a stabilized posture lying toward the body 7, that is, a forward lying posture, and is in an inclined state where the grip portion 93 side is positioned above the shaft 91 side. As shown in FIG. 8, when reaching a rear limit position of the rotation range, the pull 9 is in a stabilized posture lying toward the body 7, that is, a rearward lying posture. The pull 9 in the rearward lying posture is parallel to the front-rear direction. As shown in FIGS. 6 and 7, in the middle of the rotation range, the pull 9 is in a stabilized posture standing upright with respect to the body 7, that is, an upright posture.

Figure 2:
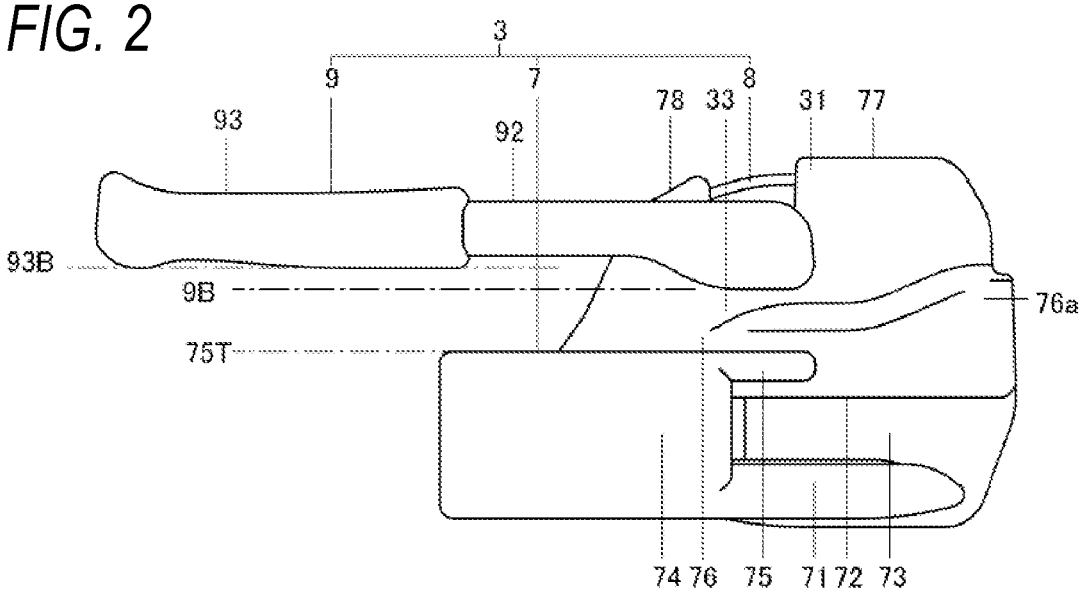
FIG. 2 is a right side view showing the concealed-slide-fastener slider according to the first embodiment of the present invention.
Figure 3:
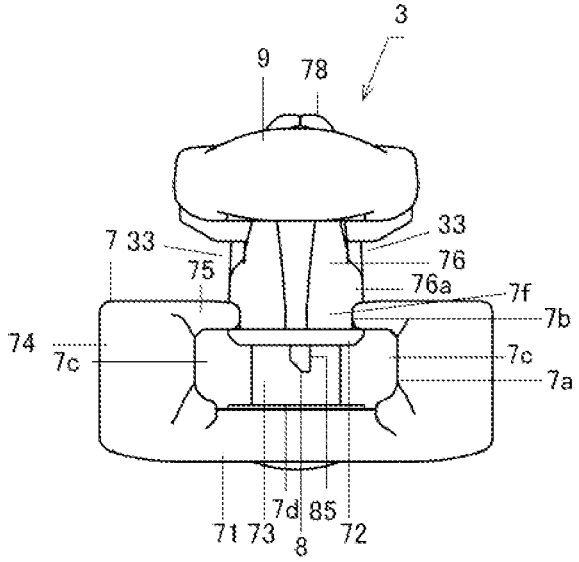
FIG. 3 is a front view showing the concealed-slide-fastener slider according to the first embodiment of the present invention.
Figure 4A:
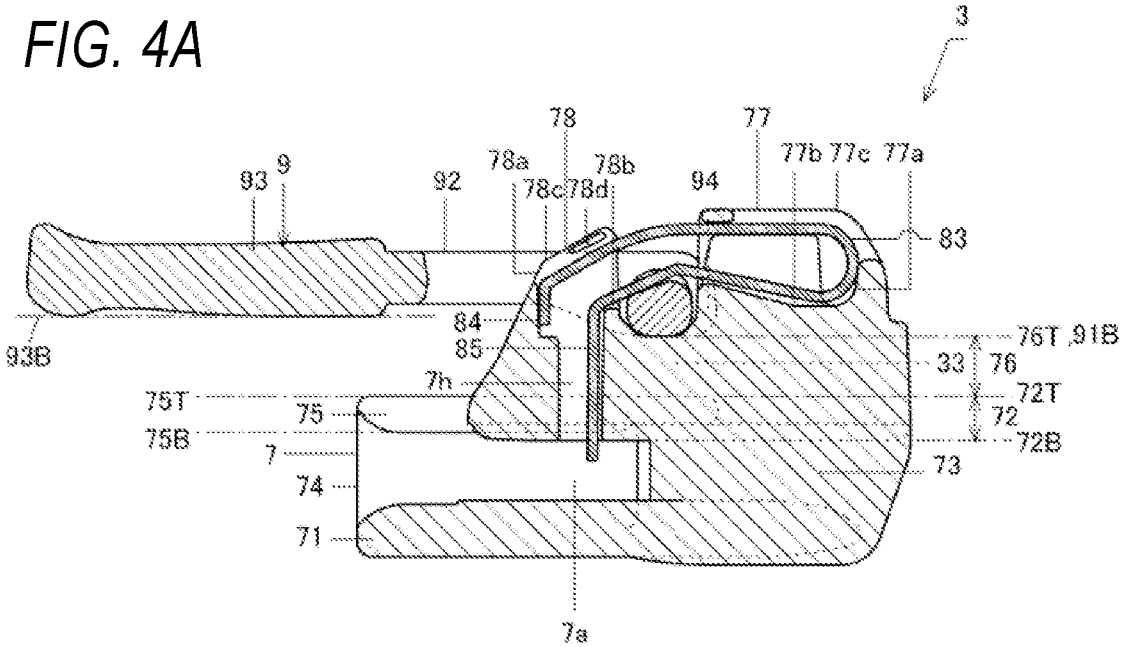
FIG. 4A is a cross-sectional view taken along line IV-IV of FIG. 1.

As shown in FIG. 4A, the rod portion 92 and the protruding portion 94 have a height equal to or higher than a lower end 91B of the shaft 91 when the pull 9 is in the rearward lying posture. As shown in FIG. 2, a lower end 93B of the grip portion 93 is positioned higher than a lower end 9B of the pull 9 when the pull 9 is in the rearward lying posture.

As shown in FIG. 8, a part of the rod portion 92 and a part of the protruding portion 94 are lower than the lower end 91B of the shaft 91 when the pull 9 is in the forward lying posture. As shown in FIG. 1, the pair of rod portions 92, 92, the shaft 91, and the grip portion 93 cooperate with each other and form an annular shape. A through hole 9*a* is formed on an inner side of the annular shape.

Figure 4B:
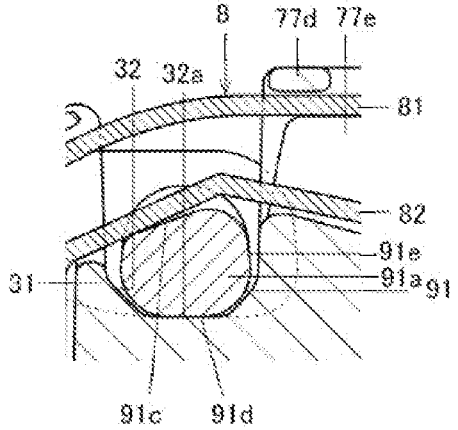
FIG. 4B is a partial enlarged view of FIG. 4A.

The shaft 91 is a rotation center of the pull 9, and extends in the left-right direction. An intermediate portion of the shaft 91 in a longitudinal direction thereof (the left-right direction) serves as a cam portion 91*a* that engages with the lock member 8. Portions of the shaft 91, located on left and right sides with respect to the cam portion 91*a*, serve as a pair of shaft main body portions 91*b*, 91*b*, which are supported by a shaft hole 32 of a pull attachment portion 31 described below when the pull 9 is rotated. The cam portion 91*a* has an outer periphery which is not constant with respect to a center line of the shaft 91. As shown in FIG. 4B, a cam recessed portion 91*c*, which is recessed in a radial direction of the shaft 91 toward a virtual surface obtained by extending outer peripheral surfaces of the pair of shaft main body portions 91*b*, 91*b*, is provided on an outer peripheral surface of the cam portion 91*a*.

As shown in FIGS. 1 to 5, the body 7 includes: a lower wing plate 71; an upper wing plate 72 that faces a width central portion of the lower wing plate 71 at a front portion of the lower wing plate 71; a guide column 73 that joins the upper wing plate 72 and the lower wing plate 71 and extends in the up-down direction; a pair of side plates 74, 74 protruding upward from left and right end portions of the lower wing plate 71; a pair of flanges 75, 75 extending from upper ends of the pair of side plates 74, 74 so as to approach left and right inner sides; a raised portion 76 raised upward from the upper wing plate 72; and a front attachment column 77 and a rear attachment column 78 protruding upwardly from the raised portion 76 with an interval therebetween in the front-rear direction. A portion of the body 7, in which the lower wing plate 71, the upper wing plate 72, the guide column 73, the pair of side plates 74, 74, and the pair of flanges 75, 75 are provided, is also referred to as a body portion. The body portion is disposed on the back side of the pair of fabrics 6, 6.

The body 7 is a space portion, which includes: an element path 7*a*, whose front and rear surfaces are penetrated in the front-rear direction, the pair of element rows 5, 5 passing through the element path 7*a*; and a tape groove 7*b*, whose upper surface is penetrated in the front-rear direction so as to communicate with the element path 7*a*, the pair of tapes 4, 4 passing through the tape groove 7*b*.

The element path 7*a* includes: a pair of branch paths 7*c*, 7*c* branched toward left and right at a front portion of the body 7; and a merged path 7*d* in which the pair of branch paths 7*c*, 7*c* merge with each other at a rear portion of the body 7.

Figure 9:
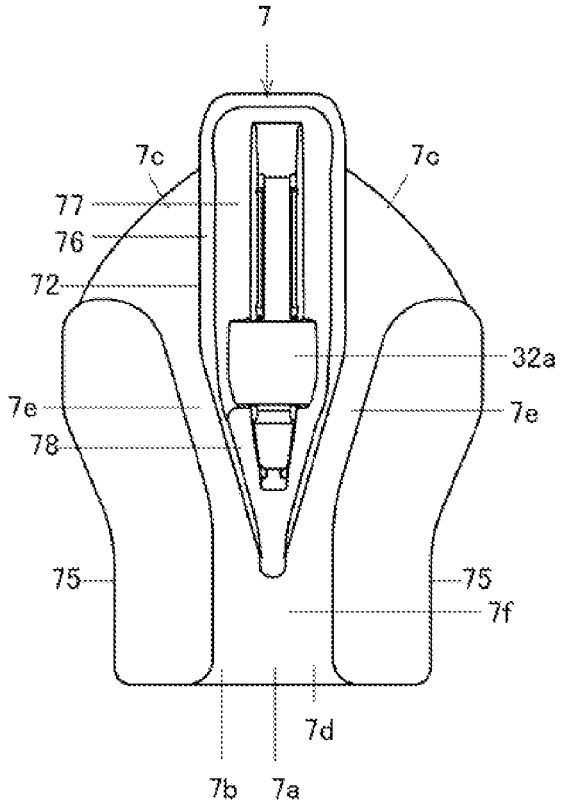
FIG. 9 is a plan view showing a body before assembly.

As shown in FIG. 9, the tape groove 7*b* also includes: a pair of branch paths 7*e*, 7*e* branched toward left and right at the front portion of the body 7; and a merged path 7*f* in which the pair of branch paths 7*e*, 7*e* merge with each other at the rear portion of the body 7.

Relationships between the body 7 and the element row 5 are as follows. As shown in FIG. 5A, an upper surface of the lower wing plate 71 guides lower sides of the pair of element rows 5, 5. Inner side surfaces (surfaces face each other in the left-right direction) of the pair of side plates 74, 74 guide left and right outer sides of the pair of element rows 5, 5. A side surface of the guide column 73 guides left and right inner sides of the pair of element rows 5, 5. Upper surfaces of the pair of flanges 75, 75 guide lower sides of the pair of tape main bodies 4*a*, 4*a*. The upper surfaces of the pair of flanges 75, 75 are horizontal surfaces. On upper sides (upper surfaces) of the pair of element rows 5, 5, the pair of tape folded portions 4*b*, 4*b* is fixed to left and right outer sides, and nothing is fixed to left and right inner sides. Lower surfaces of the pair of flanges 75, 75 guide upper sides of the pair of tape folded portions 4*b*, 4*b*, and a lower surface of the upper wing plate 72 guides the upper sides of the pair of element rows 5, 5. The lower surface of the upper wing plate 72 is positioned below the lower surfaces of the pair of flanges 75. Since the pair of element rows 5, 5 and the pair of tape folded portions 4*b*, 4*b* are guided by the body 7 in this way, a posture of the pair of stringers 2, 2 that slide in the slider 3 is stabilized.

In a plan view, as shown in FIG. 9, the merged path 7*f* of the tape groove 7*b* is formed between rear portions of the pair of flanges 75, 75, and the pair of branch paths 7*e*, 7*e* of the tape groove 7*b* is formed between front portions of the pair of flanges 75, 75 and the upper wing plate 72.

The upper wing plate 72 extends in the front-rear direction. As shown in FIG. 9, a front portion of the upper wing plate 72 is positioned in front of the pair of flanges 75, 75. A rear portion of the upper wing plate 72 extends to a rear side of the guide column 73 and is provided between the pair of flanges 75, 75 and between the pair of branch paths 7*e*, 7*e* of the tape groove 7*b*. As shown in FIG. 4A, the lower surface (lower end 72B) of the upper wing plate 72 is positioned below the lower surfaces (lower end 75B) of the pair of flanges 75, 75. Since the upper wing plate 72 and the raised portion 76 cannot be visually recognized, for convenience, the height of an upper surface (upper end 72T) of the upper wing plate 72 is made to coincide with the upper surfaces (upper ends 75T, 75T) of the pair of flanges 75, 75. The raised portion 76 is raised above the upper surface of the upper wing plate 72. Therefore, the raised portion 76 is a portion located above the upper surfaces of the pair of flanges 75, 75, and is a portion located below a lower surface of the shaft hole 32 described below, the portion including the lower surface of the shaft hole 32.

As shown in FIG. 5A, the raised portion 76 is formed between the pair of flanges 75, 75 in the left-right direction. More specifically, the raised portion 76 is formed within left and right ends of the upper wing plate 72. In other words, the raised portion 76 is formed within left and right inner sides of the pair of branch paths 7*e*, 7*e* of the tape groove 7*b*. As shown in FIG. 4A, the front attachment column 77 protrudes from a front portion of an upper surface of the raised portion 76, and the rear attachment column 78 protrudes from a rear portion of the upper surface of the raised portion 76. As shown in FIGS. 1 and 5, the front attachment column 77 and the rear attachment column 78 are formed in the left-right direction within left and right ends of the raised portion 76, more specifically, formed on inner sides than the left and right ends of the raised portion 76 in the present embodiment.

As shown in FIG. 7, when the pull 9 is in the upright posture, the raised portion 76 is sandwiched by a gap between the pair of protruding portions 94, 94 of the pull 9. Therefore, when the pull 9 in the upright posture is inclined in the left-right direction, one of the pair of protruding portions 94, 94 collides with the raised portion 76 and stops the inclination.

As shown in FIG. 1, when the pull 9 is in the rearward lying posture, the front attachment column 77, instead of the raised portion 76, is sandwiched by the gap between the pair of protruding portions 94, 94 of the pull 9. Therefore, even when the pull 9 in the rearward lying posture is inclined in the left-right direction, one of the pair of protruding portions 94, 94 collides with the front attachment column 77 and stops the inclination.

When the pull 9 is in the forward lying posture, the front attachment column 77, instead of the raised portion 76, is sandwiched by a gap between the pair of rod portions 92, 92 of the pull 9. Therefore, even when the pull 9 in the forward lying posture is inclined in the left-right direction, the pair of rod portions 92, 92 collides with the front attachment column 77 and stops the inclination. As shown in FIG. 4A, the front attachment column 77 is formed behind a front end of the raised portion 76 with respect to the front direction. Therefore, the raised portion 76 includes a step portion 76*a* that protrudes forward in a step shape toward the front attachment column 77. The step portion 76*a* protrudes from the lower surface of the shaft hole 32 in front of the front attachment column 77. As shown in FIG. 2, the step portion 76*a* protrudes in the step shape on left and right sides with respect to the front attachment column 77. In addition, the step portion 76*a* protrudes in the step shape on left and right sides with respect to a portion between the front attachment column 77 and the rear attachment column 78.

The pull 9 which is laid forward is placed on the step portion 76*a*. A front portion of the step portion 76*a* is the highest as compared with the front attachment column 77. A forward limit position of the rotation range of the pull 9 is determined by contact between the front portion of the step portion 76*a* and the pull 9 which is laid forward, and the pull 9 is thus in the forward lying posture.

As shown in FIGS. 1 and 4, the front attachment column 77 includes a front accommodating groove 77*a* that accommodates a front portion of the lock member 8 at a width central portion of an upper surface thereof. The front attachment column 77 includes: a front bottom portion 77*b*, which forms a bottom surface of the front accommodating groove 77*a*; a pair of front side wall portions 77*c*, 77*c*, which form left and right side surfaces of the front accommodating groove 77*a* and protrude upward from left and right sides toward the front bottom portion 77*b*; and a pair of front protruding portions 77*d*, 77*d*, which protrude inward in the left and right direction so as to approach the pair of front side wall portions 77*c*, 77*c* from upper ends and cover the front portion of the lock member 8 from above.

The rear attachment column 78 includes a rear accommodating groove 78*a* that accommodates a rear portion of the lock member 8 at a width central portion of an upper surface thereof. The rear attachment column 78 includes: a rear bottom portion 78*b*, which forms a bottom surface of the rear accommodating groove 78*a*; a pair of rear side wall portions 78*c*, 78*c*, which form left and right side surfaces of the rear accommodating groove 78*a* and protrude upward from left and right sides toward the rear bottom portion 78*b*; and a pair of rear protruding portions 78*d*, 78*d*, which protrude inward in the left and right direction so as to approach the pair of rear side wall portions 78*c*, 78*c* from upper ends.

The raised portion 76, the front attachment column 77, and the rear attachment column 78 cooperate with each other to form an opening portion (reference numeral omitted) which penetrates in the left-right direction and opens upward. As shown in FIGS. 1 and 2, an upper side of the opening portion is covered by the lock member 8 which is bridged over an upper portion of the front attachment column 77 and an upper portion of the rear attachment column 78. The pull attachment portion 31 is formed by attaching (connecting) the pull 9 to the body 7 by the opening portion and the lock member 8.

The pull attachment portion 31 has an annular shape in a side view, and includes the shaft hole 32 that supports the shaft 91 of the pull 9 inside the annular shape. The shaft hole 32 penetrates in the left-right direction.

As shown in FIG. 4B, in order to stabilize the lying posture when the pull 9 is in the rearward lying posture, the shaft hole 32 and the cam portion 91*a* are respectively provided with planar portions 32*a* and 91*d* which are in surface contact with each other. The planar portion 32*a* of the shaft hole 32 is a lower surface of the shaft hole 32 and is an upper surface between the front attachment column 77 and the rear attachment column 78. The planar portion 91*d* of the cam portion 91*a* is a lower surface portion when the pull 9 is in the rearward lying posture. The planar portion 32*a* of the shaft hole 32 and the planar portion 91*d* of the cam portion 91*a* are planes orthogonal to each other in the up-down direction.

The lower surface of the shaft hole 32 (the upper surface of the raised portion 76) is a surface on which the shaft 91 (planar portion 91*d* of the cam portion 91*a*) of the pull 9 is placed. The planar portion 91*d* (the lower end 91B of the shaft 91) of the cam portion 91*a* of the pull 9 overlaps the upper surface (upper end 76T) of the raised portion 76 and is placed thereon when the pull 9 is in the rearward lying posture. An lower end of the pull 9 in the rearward lying posture is the shaft 91. Therefore, the pull 9 in the rearward lying posture is disposed at the higher position than the lower surface of the shaft hole 32. The grip portion 93 of the pull 9 in the rearward lying posture is positioned above a lower surface of the shaft 91 in consideration of operability. Therefore, a lower end 93B of the grip portion 93 is positioned above the planar portion 91*d* of the cam portion 91*a* of the pull 9 when the pull 9 is in the rearward lying posture. A virtual line, which is horizontal with the lower end 91B of the planar portion 91*d* of the cam portion 91*a* of the pull 9 and is positioned above the lower end 91B of the planar portion 91*d* of the cam portion 91*a* of the pull 9, is defined by the lower end 93B of the grip portion 93 when the pull 9 is in the rearward lying posture. A fabric accommodating space portion 33 described below is formed between the virtual line and the upper surfaces of the flanges 75, 75.

The cam portion 91*a* includes another planar portion 91*e* in front of the planar portion 91*d* when the pull 9 is in the rearward lying posture. The planar portion 91*e* is a plane orthogonal to the front-rear direction, and stabilizes the upright posture of the pull 9 as shown in FIG. 6.

In this way, when the pull 9 is in the upright posture and the rearward lying posture, since the shaft hole 32 and the cam portion 91*a* are in surface contact with each other, the postures are stabilized, and the stabilized postures are maintained by the locking member 8.

As shown in FIGS. 4A and 4B, the lower surface of the shaft hole 32 is the upper surface of the raised portion 76, and is positioned above the upper surface of the flange 75. In other words, the raised portion 76 has a thickness that enables the upper surface thereof (the lower surface of the shaft hole 32) to be positioned above the upper surface of the flange 75. As shown in FIG. 5A, between the pair of flanges 75, 75 and the pull 9, a pair of fabric accommodating space portions 33, 33 that accommodate a pair of fabrics 6, 6 are formed in a state of being partitioned by the raised portion 76 in the left and right direction.

As shown in FIG. 5A, an upper limit position of the fabric accommodating space portion 33 is determined by a lower surface of the pull 9. A lower limit position of the fabric accommodating space portion 33 is determined by the upper surfaces of the pair of flanges 75, 75 and upper surfaces of the pair of branch paths 7*e*, 7*e* of the tape groove 7*b*. The height of the upper surfaces of the pair of branch paths 7*e*, 7*e* coincides with the upper surfaces (upper end 75T) of the pair of flanges 75, 75. Left-right direction inner limit positions of the fabric accommodating space portion 33 are determined by left and right side surfaces of the raised portions 76. Left-right direction outer limit positions of the fabric accommodating space portion 33 are not determined.

Only the pair of fabric accommodating space portions 33, 33 is provided in upper ranges 75R, 75R on the upper surfaces of the pair of flanges 75, 75 and is disposed at the lower position than the pull 9. The upper ranges 75R, 75R are defined by peripheries of the upper surfaces of the pair of flanges 75, 75. In other words, the upper ranges 75R, 75R only include the pair of fabric accommodating space portions 33, 33 between the upper end 75T of the pair of flanges 75, 75 and the lower end 9B of the pull 9. Therefore, the only tangible object present in the upper ranges 75R, 75R on the upper surfaces of the pair of flanges 75, 75 is the pull 9. For this reason, when the slider 3 is not attached to the fastener stringer 2, the pull 9 and the upper surfaces of the flanges 75, 75 face each other in the upper ranges 75R, 75R when the pull 9 is laid rearward. The raised portion 76 does not exist in the upper ranges 75R, 75R on the upper surfaces of the pair of flanges 75, 75.

As shown in FIG. 7, only the pair of fabric accommodating space portions 33, 33 is provided in upper ranges 7R, 7R on the pair of branch paths 7*e*, 7*e* and is disposed at the lower position than the pull 9. This is because the raised portion 76 is formed within the left and right ends of the upper wing plate 72 as described above. Therefore, the only tangible object present in the upper ranges 7R, 7R on upper surfaces of the pair of branch paths 7*e*, 7*e* is the pull 9. The raised portion 76 does not exist in the upper ranges 7R, 7R on the upper surfaces of the pair of branch paths 7*e*, 7*e*.

Since the tape main body 4*a* is disposed above the flange 75, not only the fabric 6 but also the tape main body 4*a* is accommodated in the fabric accommodating space portion 33. More specifically, the fabric accommodating space portion 33 accommodates the fabric 6 whose facing side edge portion is folded toward a back side so as to be two-fold, and the tape main body 4*a* positioned on the upper surface side of the flange 75.

An up-down interval between the pair of fabric accommodating space portions 33, 33 equals to an up-down interval between the pull 9 and the pair of flanges 75, 75, and a minimum distance thereof is preferably set to 2 mm or more. As shown in FIG. 7, when the pull 9 is in the upright posture, the pair of protruding portions 94, 94 is positioned below the shaft 91. As shown in FIG. 4A, when the pull 9 is in the rearward lying posture, the lower end 91B of the shaft 91, lower ends of the pair of rod portions 92, 92 and lower ends of the pair of protruding portions 94, 94 have the same height. As shown in FIG. 8, when the pull 9 is in the forward lying posture, the lower ends of the pair of protruding portions 94, 94 and the lower ends of the pair of rod portions 92, 92 are positioned below the lower end 91B of the shaft 91. It is desirable that the fabric accommodating space portion 33 is set to 2 mm or more in any posture. In the present embodiment, the pair of fabric accommodating space portions 33, 33 is bilaterally symmetrical.

In order to maximize the fabric accommodating space portion 33, as shown in FIG. 5B, the pair of rod portions 92, 92 includes first inclined surfaces 95, 95 that extends upward away from the shaft 91, respectively on portions located on lower surfaces on opposite sides of the shaft 91 when the pull 9 is in the rearward lying posture. Although not shown, the first inclined surface 95 is also formed continuously in the protruding portion 94.

In order to maximize the fabric accommodating space portion 33, as shown in FIG. 7, the pair of protruding portions 94, 94 includes second inclined surfaces 96, 96 that extends upward away from the shaft 91, respectively, on portions located on lower surfaces on opposite sides of the shaft 91 when the pull 9 is in the upright posture. The pair of second inclined surfaces 96, 96 is also formed continuously in the pair of rod portions 92, 92.

As described above, the lock member 8 locks the front-rear position of the body 7 with respect to the pair of element rows 5, 5 through contacting the pair of element rows 5, 5, and on the contrary releases the locking of the front-rear position of the body 7 with respect to the pair of element rows 5, 5 through being separated from the pair of element rows 5, 5. The lock member 8 is formed by bending a metal plate into a predetermined shape, which is a so-called plate spring. As shown in FIG. 4A, the lock member 8 includes: an upper plate 81 and a lower plate 82 facing each other in the up-down direction; a joining plate 83 that joins front ends of the upper plate 81 and the lower plate 82; an insertion plate 84 extending downward from a rear end of the upper plate 81 and inserted into a rear portion of the rear accommodating groove 78*a* of the rear attachment column 78; and a pawl plate 85 extending downward from a rear end of the lower plate 82.

The joining plate 83 has a shape that bulges forward, more specifically, is curved in an arc shape.

The upper plate 81 has a shape whose middle portion in the front-rear direction is positioned above a virtual straight line connecting two ends of the upper plate 81 in the front-rear direction. The upper plate 81 is a curved plate when viewed from a side surface. More specifically, when the upper plate 81 is viewed from a side surface, a front portion and a rear portion of an entire length in the front-rear direction thereof are straight line portions, and the middle portion in the front-rear direction is a smoothly continuous curved portion curved with respect to the front and rear straight portions. The rear straight portion is positioned below a virtual straight line extending rearward from the front straight portion. A tangential direction with respect to front and rear ends of the curved portion coincides with an extending direction of the front and rear straight line portions.

A front portion of the upper plate 81 is accommodated in the front accommodating groove 77*a*. Left and right sides and a lower side thereof are supported by the pair of front side wall portions 77*c*, 77*c*. An upper side thereof is pressed by the pair of front protruding portions 77*d*, 77*d*. In order to support the lower side of the upper plate 81, lower portions of the pair of front side wall portions 77*c*, 77*c* are formed to be a pair of shelf portions 77*e*, 77*e* protruding to approach left and right inner sides with respect to upper portions of the pair of front side wall portions 77*c*, 77*c*. The upper plate 81 is placed on the pair of shelf portions 77*e*, 77*e*.

The upper side of the upper plate 81 is not only pressed by the pair of front protruding portions 77*d*, 77*d*, but also by the pair of front side wall portions 77*c*, 77*c*. Therefore, as shown in FIG. 5B, upper end portions of the pair of front side wall portions 77*c*, 77*c* are bent downward to cover the upper plate 81 from above.

The lower plate 82 also has a shape whose middle portion in the front-rear direction is positioned above a virtual straight line connecting two ends of the lower plate 82 in the front-rear direction. The lower plate 82 is a bent plate when viewed from a side surface. More specifically, when the lower plate 82 is viewed from a side surface, a front portion and a rear portion in the front-rear direction thereof are straight line portions, and the front straight line portion and the rear straight line portion are continuous in a bent state. The front straight line portion of the lower plate 82 extends downward toward the front. The rear straight line portion of the lower plate 82 extends downward toward the rear. The lower plate 82 is placed on the cam portion 91*a* of the shaft 91 of the pull 9, and presses the cam portion 91*a* from above by a restoring force thereof.

When the pull 9 is in the rearward lying posture, the lower plate 82 presses the cam recessed portion 91*c*, which is an upper surface of the shaft 91, from above, thereby stabilizing the shaft 91 and the rearward lying posture of the pull 9. When a posture of the pull 9 is between the rearward lying posture and the upright posture, the lower plate 82 presses the cam portion 91*a* from above by the restoring force and presses the pull 9 into the rearward lying posture. When the pull 9 is in the upright posture and the forward lying posture, the lower plate 82 also presses the cam portion 91*a* from above by the restoring force and stabilizes the postures.

A tip portion (lower portion) of the pawl plate 85 enters the element path 7*a* of the body 7. For this reason, the rear attachment column 78, the raised portion 76, and the upper wing plate 72 are formed with pawl hole 7*h* communicating with the rear accommodating groove 78*a* and the element path 7*a* (the merged path 7*d*) and penetrating in the up-down direction. The pawl plate 85 is accommodated in the pawl hole 7*h*.

Depending on engagement between the lower plate 82 of the lock member 8 and the cam portion 91*a* of the shaft 91, an entering amount (length) of the tip portion of the pawl plate 85 entering the element path 7*a* is changed.

As shown in FIG. 4A, when the pull 9 is in the rearward lying posture, the tip portion of the pawl plate 85 is deeply inserted into the element path 7*a*, and is inserted into an element row (not shown) so as to contact the element row, thereby locking the front-rear position of the body 7 with respect to the pair of element rows and restricting movement of the slider 3 in the front-rear direction.

As shown in FIG. 6, when the pull 9 is in the upright posture, the tip portion of the pawl plate 85 is accommodated in the pawl hole 7*h* without being inserted into the element path 7*a*, thereby releasing the locking of the front-rear position of the body 7 with respect to the pair of element rows and releasing restriction of the movement of the slider 3 in the front-rear direction.

As shown in FIG. 8, when the pull 9 is in the forward lying posture, the tip portion of the pawl plate 85 is accommodated in the pawl hole 7*h* without being inserted into the element path 7*a*, thereby releasing the restriction of the movement of the slider 3 in the front-rear direction.

The insertion plate 84 is accommodated in the rear accommodating groove 78*a* behind the pawl hole 7*h*.

The slider 3 of the first embodiment described above has the following effects.

The slider 3 restricts or releases the restriction of the movement of the body 7 in the front-rear direction by the upright posture and the rearward lying posture of the pull 9 with respect to the body 7. As shown in FIGS. 4 and 5, in the slider 3, the raised portion 76 is provided above the upper wing plate 72, so that the up-down interval between the pull 9 and the pair of flanges 75 is increased. In the slider 3, the pair of fabric accommodating space portions 33, 33 is partitioned into left and right portions by the raised portion 76 between the pull 9 and the pair of flanges 75, 75 in the upper-lower direction, so that the pull 9, the front attachment column 77, the rear attachment column 78, and the lock member 8 appear on the front side of the pair of fabrics 6, 6.

In the slider 3, the pair of fabric accommodating space portions 33, 33 is formed while the lower surface of the shaft hole 32 is positioned above the upper surfaces of the pair of flanges 75, 75 by the raised portions 76, so that the pull 9 is difficult to contact the pair of fabrics 6, 6, and the damage dealt to the pair of fabrics 6, 6 can be reduced as compared with a slider in which the lower surface of the shaft hole is positioned below the upper surfaces of the pair of flanges. The pull 9 does not contact the pair of the fabrics 6, 6, thus the restriction of the movement of the slider 3 in the front-rear direction is prevented from being released. If the pull 9 contacts the pair of fabrics 6, 6, the pull 9 is close to the upright posture, the tip portion of the pawl plate 85 does not protrude into the element path 7*a*, and the restriction of the movement of the slider 3 in the front-rear direction is released.

In the slider 3, only the pair of fabric accommodating space portions 33, 33 is provided in the upper ranges 75R, 75R on the upper surfaces of the pair of flanges 75, 75 is disposed at the lower position than the pull 9, so that the pull 9 is difficult to contact the pair of fabrics 6, 6, and the damage dealt to the pair of fabrics 6, 6 can be reduced as compared with a slider in which the raised portion 76 protrudes to the upper ranges 75R, 75R on the upper surfaces of the pair of flanges 75, 75, for example. More specifically, in the slider 3, only the pair of fabric accommodating space portions 33, 33 is provided in the upper ranges on the pair of branch paths 7*e*, 7*e* is disposed at the lower position than the pull 9, so that the pull 9 is difficult to contact the pair of fabrics 6, 6, and the damage dealt to the pair of fabrics 6, 6 can be reduced as compared with a slider in which the raised portion 76 protrudes to the upper ranges 7R, 7R on the pair of branch paths 7*e*, 7*e*, for example.

In the slider 3, the cam portion 91*a* and the shaft hole 32 each include the planar portions 91*d*, 32*a* which are in surface contact with each other when the pull 9 is in the rearward lying posture, so that the size of the slider 3 can be reduced, and portions appearing on the front side with respect to the pair of fabrics 6, 6 can be minimized as compared with a slider in which portions for maintaining the rearward lying posture of the pull are provided in portions other than the cam portion 91*a* and the shaft hole 32, for example.

In the slider 3, the pull 9 in the rearward lying posture is disposed at the higher position than the lower surface of the shaft hole 32, so that dimensions of the pair of fabric accommodating space portions 33, 33 in the up-down direction can be maximized, and the pull 9 is difficult to contact the pair of fabrics 6, 6, as a result the damage dealt to the pair of fabrics 6, 6 can be further reduced as compared with a slider in which the pull (more specifically the lower surface of the pull) in the rearward lying posture includes a portion positioned below the lower surface of the shaft hole 32. Since the pair of fabric accommodating space portions 33, 33 are widened by the pair of first inclined surfaces 95, 95, the damage dealt to the pair of fabrics 6, 6 can be further reduced.

In the slider 3, when the pull 9 is in the rearward lying posture, the front attachment column 77 is sandwiched by the gap between the pair of protruding portions 94, 94, so that one of the protruding portions 94 collides with the front attachment column 77 when the pull 9 is inclined in the left-right direction, as a result the inclination of the pull 9 in the left-right direction can be minimized, and the rearward lying posture of the pull 9 is stabilized.

As shown in FIG. 7, in the slider 3, when the pull 9 is in the upright posture, the raised portion 76 is sandwiched by the gap between the pair of protruding portions 94, 94, so that one of the protruding portions 94 collides with the raised portion 76 when the pull 9 is inclined in the left-right direction, as a result the inclination of the pull 9 in the left-right direction can be minimized, and the upright posture of the pull 9 is stabilized.

In the slider 3, when the pull 9 is in the forward lying posture, the pull 9 is placed on the step portion 76*a*, so that the forward lying posture of the pull 9 is stabilized, and the pair of fabric accommodating space portions 33, 33 can be maintained, so that the damage dealt to the pair of fabrics 6, 6 can be reduced. Since the pair of fabric accommodating space portions 33, 33 are widened by the pair of second inclined surfaces 96, 96, the damage dealt to the pair of fabrics 6, 6 can be further reduced.

In the slider 3, when the pull 9 is in the forward lying posture, a front end portion of the pull 9 is positioned above the lower end of the shaft 91, so that the front end portion of the pull 9 is higher than the pair of fabric accommodating space portions 33, 33, and the pull 9 is easily operated.

Further, in the slider 3, when the pull 9 is in the forward lying posture, the front attachment column 77 is sandwiched by the gap between the pair of rod portions 92, 92 of the pull 9, so that the pair of rod portions 92, 92 collides with the front attachment column 77 when the pull 9 is inclined in the left-right direction, as a result the inclination of the pull 9 in the left-right direction can be minimized, and the forward lying posture of the pull 9 is stabilized.

The present invention is not limited to the above-described embodiment, and modifications can be made without departing from the scope thereof. For example, although in the slider 3 in the above embodiment, the front portion and the rear portion of the lock member 8 are both fixed to the body 7, and the pull 9 is supported only by the pull attachment portion 31, the present invention is not limited thereto, and, for example, the front portion of the lock member may be fixed to the body while the rear portion may be held to be displaceable in the up-down direction, and the pull may be supported by a pair of reinforcement portions, formed on left and right sides with respect to the pull attachment portion, and the pull attachment portion. In this case, the lock member is not bent in a manner that an upper portion and a lower portion thereof face each other, but is bent in the up-down direction from the front portion to the rear portion of the body. In this case, the pull attachment portion is formed by the raised portion and the lock member. In this case, each of the reinforcement portions includes a pair of column portions that is located on a left or right side with respect to the pull attachment portion and protrude upward from the upper wing plate with an interval therebetween. Before attaching the pull to the body, an interval is separated between upper portions of the pair of column portions by a distance larger than a diameter of the shaft, so that the shaft can be dropped and inserted from above the pair of column portions. After the shaft is inserted into the pair of column portions, the upper portions of the pair of column portions are plastically deformed so as to approach each other, so that the interval between the upper portions of the pair of column portions becomes smaller than the diameter of the shaft, thereby preventing the shaft from moving upward with respect to the pair of column portions.

What is claimed is:

1. A concealed-slide-fastener slider comprising:

a body configured to guide a pair of tapes and a pair of element rows, the pair of tapes facing each other in a left-right direction and the pair of element rows fixed to lower sides of a pair of tape folded portions of side edge portions of the pair of the tapes, the side edge portions facing each other, and the tape folded portions being folded toward the lower sides;

a pull configured to restrict movement of the body in a front-rear direction by a rearward lying posture with respect to the body and to release the restriction of the movement of the body in the front-rear direction by an upright posture; and a lock member configured to lock a front-rear position of the body by contacting the pair of the element rows, the lock member further configured to cooperate with the body to maintain the rearward lying posture and the upright posture of the pull; wherein:

the body comprises a lower wing plate; an upper wing plate facing a front portion of the lower wing plate; a guide column joining the upper wing plate and the lower wing plate; a pair of side plates protruding upward from left and right end portions of the lower wing plate; a pair of flanges extending inwardly in the left and right direction from upper end portions of the pair of side plates; and a raised portion raised upward from the upper wing plate;

the pull comprises a shaft, the shaft comprising a cam portion engaged with the lock member;

the body cooperates with the lock member to form a pull attachment portion;

the pull attachment portion defines a shaft hole that supports the shaft and penetrates in the left-right direction;

a lower surface defining the shaft hole further defines an upper surface of the raised portion and is disposed at a higher position than upper surfaces of the pair of the flanges; and a pair of fabric accommodating space portions are formed in an upper-lower direction between the pull in the rearward lying posture and the pair of the flanges, the pair of fabric accommodating space portions accommodating a pair of fabrics fixed to upper sides of the pair of the tapes, and the pair of fabric accommodating space portions being partitioned by the raised portion in the left-right direction.

2. The concealed-slide-fastener slider according to claim 1, wherein only the pair of fabric accommodating space portions are provided in upper ranges on the upper surfaces of the pair of the flanges and are disposed at lower positions than the pull.

3. The concealed-slide-fastener slider according to claim 2, wherein:

the body defines a pair of branch paths of a tape groove between the pair of the flanges and the upper wing plate, and only the pair of fabric accommodating space portions are provided in upper ranges on the pair of branch paths and are disposed at lower positions than the pull.

4. The concealed-slide-fastener slider according to claim 1, wherein:

the body comprises a front attachment column and a rear attachment column protruding upwardly from the raised portion with an interval therebetween in the front-rear direction;

the lock member is bridged between the front attachment column and the rear attachment column; and the pull attachment portion is formed by cooperation of the lock member, the front attachment column, the rear attachment column, and the raised portion.

5. The concealed-slide-fastener slider according to claim 4, wherein:

the pull further comprises a pair of rod portions that extend from two end portions of the shaft, a grip portion that joins the pair of rod portions on a side of the pull opposite from the shaft, and a pair of protruding portions protruding from the pair of rod portions to on a side of the pull opposite from the side comprising the grip portion, and the pair of protruding portions sandwich the front attachment column when the pull is in the rearward lying posture and collides with the front attachment column when the pull is inclined in the left-right direction.

6. The concealed-slide-fastener slider according to claim 4, wherein the raised portion comprises a step portion that protrudes in a step shape toward the front attachment column in front of the shaft hole, and the step portion collides with the pull in a forward lying posture to determine the forward lying posture of the pull.

7. The concealed-slide-fastener slider according to claim 1, wherein the cam portion and the shaft hole comprise planar portions respectively, and the planar portions come in surface contact with each other when the pull is in the rearward lying posture.

8. The concealed-slide-fastener slider according to claim 1, wherein the pull is positioned above the lower surface of the shaft hole when the pull is in the rearward lying posture.

* * * * *